US006149979A

United States Patent [19]

Kushibiki et al.

[11] Patent Number: 6,149,979

[45] Date of Patent: Nov. 21, 2000

[54] PROCESS FOR THE PREPARATION OF PHOTOSENSITIVE BODY SURFACE COATING MATERIAL

[76] Inventors: Nobuo Kushibiki, 2-21-10-305, Tsujido Motomachi, Fujisawa-shi, Kanagawa; Kikuko Takeuchi, Room No. 102, 411-5 Kitanokubo, Odawara-shi, Kanagawa; Hideki Kobayashi, 426-14, Saihiro, Ichihara-shi, Chiba Prefecture; Toru Masatomi, 6, 1-chome, Yushudai Nishi, Ichihara-shi, Chiba Prefecture, all of Japan

[21] Appl. No.: 09/040,888

[22] Filed: Mar. 18, 1998

[30] Foreign Application Priority Data

Mar. 19, 1997 [JP] Japan ..... 9-066841
Aug. 29, 1997 [JP] Japan ..... 9-235042

[51] Int. Cl.[7] ..... B05D 3/02

[52] U.S. Cl. ..... 427/387; 528/42; 524/588; 524/847; 524/858; 524/859

[58] Field of Search ..... 528/42; 524/588, 524/847, 858, 859; 427/387

[56] References Cited

U.S. PATENT DOCUMENTS 3,453,232 7/1969 Larson ..... 528/42
3,986,997 10/1976 Clark ..... 260/29.2 M

FOREIGN PATENT DOCUMENTS 57-30843 4/1982 Japan .
5-46940 3/1993 Japan .

*Primary Examiner*—Melvyn I. Marquis

[57] ABSTRACT

A process for the preparation of a photosensitive body surface coating material comprises hydrolytically condensing an alkoxysilane in a mixed solvent comprising an alcohol and water in the presence of finely divided silica. A polysiloxane resin is produced by heat curing the silane after its hydrolytic condensation. The polysiloxane resin has the formula: $R^1SiO_{3/2}$, and $R^1$ comprises fluorohydrocarbon groups. The photosensitive body surface coating material is not detrimental to the functionality required of the electrophotographic photosensitive bodies, has superior optical uniformity, has low surface energy, and has superior surface hardness.

16 Claims, 1 Drawing Sheet

PROCESS FOR THE PREPARATION OF PHOTOSENSITIVE BODY SURFACE COATING MATERIAL

FIELD OF THE INVENTION

This invention relates to a process for the preparation of a coating material that can be applied in the surface layer of electrophotographic photosensitive bodies. The coating material can impart low surface energy and wear resistance.

BACKGROUND OF THE INVENTION

Repeated mechanical or electrical operations, such as cleaning, transfer, or image development processes; or, electrical charging processes, such as roller electrical charging and corona electrical charging; affect the surface of photosensitive bodies. Because the surfaces of photosensitive bodies are subjected to wear and undergo degradation due to friction and such during cleaning or electrical charging, there is a demand for improvements in durability of photosensitive bodies.

Attempts to improve characteristics by reducing surface energy by adding polydimethylsiloxane oil, polytetrafluoroethylene, and the like, to the photosensitive layer itself are known in the art.

Furthermore, attempts have been made to form a new protective layer on the surface of the photosensitive body. For example, using coating materials obtained by dispersing electrically conductive particles in various resins was suggested in JP-A-57-30843 (1982). Applying to photosensitive body surfaces, a surface-protecting layer of crosslinked polysiloxane composed of a product of joint hydrolytic condensation of a trifunctional alkoxysilane and a tetrafunctional alkoxysilane was suggested in JP-C-05-46940 (1993).

Because the solubility of fluorine-containing high polymers, such as polytetrafluoroethylene, is extremely poor and an optically uniform dispersion is extremely difficult to obtain, and because the computability of fluorine-containing high polymers is poor when they are added to resin, agglutination and optical scattering occur. Additionally, such high polymer particles can bleed onto the surface of the photosensitive body. When polysiloxanes are added, the tendency to bleed is quite strong, and the effects are not long lasting.

When resins containing metal oxide particles were used in the protective layer, surface hardness improved. However, surface energy increased, cleaning characteristics became inferior, and particles underwent agglutination, producing optical scattering. Also, forming the protective layer of polysiloxane was detrimental to the charge transfer properties of the photosensitive body due to the insulating properties of the polysiloxane.

One object of this invention is to provide a process for the preparation of a coating material that forms a protective layer for electrophotographic photosensitive bodies. A further object of this invention is to provide a coating material that is not detrimental to the functionality required of the electrophotographic photosensitive bodies and that has superior optical uniformity, low surface energy, and superior surface hardness.

SUMMARY OF THE INVENTION

This invention relates to a process for the preparation of a photosensitive body surface coating material. The process comprises subjecting a silane to hydrolytic condensation in a mixed solvent comprising an alcohol and water in the presence of finely divided silica. The silane has the formula $R^2Si(OR^3)_3$, wherein each $R^2$ is a group selected from the group consisting of fluorohydrocarbon groups of 3 to 12 carbon atoms; saturated hydrocarbon groups of 1 to 18 carbon atoms, with the proviso that the saturated hydrocarbon groups may have oxygen atoms; and aromatic hydrocarbon groups of 6 to 18 carbon atoms. Each $R^3$ is a straight-chain saturated hydrocarbon group of 1 to 8 carbon atoms.

The polysiloxane resin is produced by heat curing the silane after its hydrolytic condensation. The polysiloxane resin has the formula $R^1SiO_{3/2}$, wherein each $R^1$ is a group selected from the group consisting of fluorohydrocarbon groups of 3 to 12 carbon atoms; saturated hydrocarbon groups of 1 to 18 carbon atoms, with the proviso that the saturated hydrocarbon groups may have oxygen atoms; and aromatic hydrocarbon groups of 6 to 18 carbon atoms; with the proviso that not less than 1 mol % and not more than 80 mol % of all the $R^1$ groups are fluorohydrocarbon groups.

DETAILED DESCRIPTION OF THE INVENTION

Figure 1:
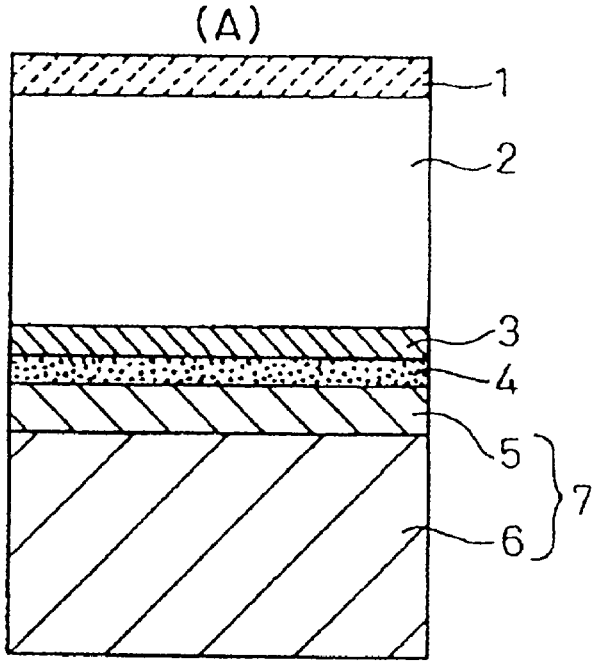
FIG. 1(A) and FIG. 1(B) are schematic cross sections of electrophotographic photosensitive bodies.
Figure 1:
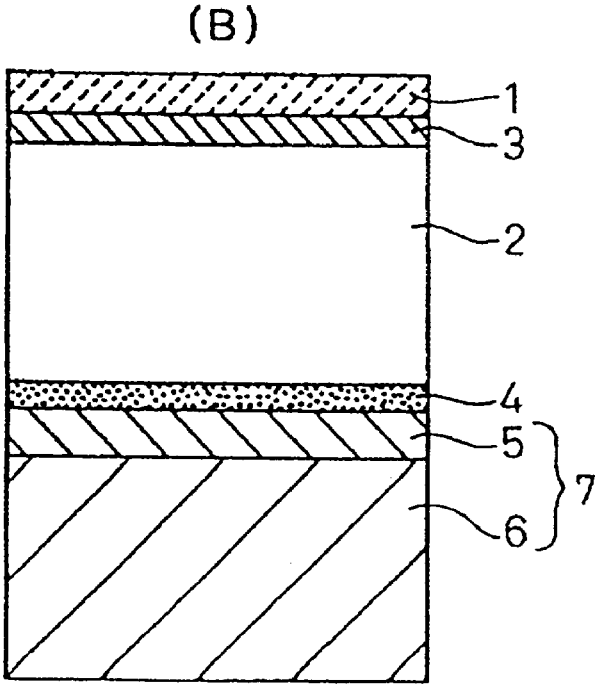

This invention relates to a process for the preparation of a photosensitive body surface coating material. The process comprises producing a polysiloxane by subjecting a silane to hydrolytic condensation in a mixed solvent comprising an alcohol and water in the presence of finely divided silica. The silane has the formula $R^2Si(OR^3)_3$, wherein each $R^2$ is a group selected from the group consisting of fluorohydrocarbon groups of 3 to 12 carbon atoms; saturated hydrocarbon groups of 1 to 18 carbon atoms, with the proviso that the saturated hydrocarbon groups may have oxygen atoms; and aromatic hydrocarbon groups of 6 to 18 carbon atoms. Each $R^3$ is a straight-chain saturated hydrocarbon group of 1 to 8 carbon atoms. The weight of water in the solvent is not less than the weight necessary for the hydrolytic condensation of the silane.

After hydrolytic condensation of the silane to produce the polysiloxane, the photosensitive body surface coating material is heat cured, and thereby transformed into a resin comprising finely divided silica and a polysiloxane resin of the formula $R^1SiO_{3/2}$, wherein each $R^1$ is a group selected from fluorohydrocarbon groups of 3 to 12 carbon atoms; saturated hydrocarbon groups of 1 to 18 carbon atoms, with the proviso that the saturated hydrocarbon groups may have oxygen atoms; and aromatic hydrocarbon groups of 6 to 18 carbon atoms. Not less than 1 mol % and not more than 80 mol % of all the $R^1$ groups are fluorohydrocarbon groups.

Generally, when the length of the chain of $R^1$ increases, the strength of the heat cured product of the coating material drops, and surface tension tends to decrease, which has serious effects on surface tension. Although the surface tension of the cured product decreases when the amount of fluorohydrocarbon groups in $R^1$ exceeds 80 mol %, its surface hardness decreases as well, which is undesirable. Furthermore, the product becomes opaque when groups with significant fluorohydrocarbon chain length are introduced. For electrophotographic photosensitive bodies, a water contact angle of not less than 95° on their surface is required for good cleaning characteristics, and the like. When the amount of fluorohydrocarbons in $R^1$ is less than 1 mol %, the resultant change in the surface tension of the cured product is too small, and sufficient effects such as a water contact angle of not less than 95°, cannot be expected.

For example, when the silicon-bonded groups other than the fluorohydrocarbon groups were methyl groups, the water angle was 92°. However, the water contact angle changed to 113° when 50 mol % of the methyl groups were replaced with groups containing perfluorobutyl. For this reason, surface hardness changed from not less than 9H to 7H. For perfluoroctylethyl, when 2% of the methyl groups are replaced thereby, the water contact angle becomes 105°; and when a significant amount is replaced, the resin becomes opaque upon curing. An essential condition for the heat cured product is that light of a specified wavelength should reach the charge generating layer of the photosensitive body. For high sensitivity and high resolution it is desirable that light scattering should not be generated.

Groups obtained by bonding perfluorocarbon groups represented by the formula $C_nF_{2n+1}$ to silicon atoms through ethylene groups are appropriate for use as $R^2$ of the silane. Suitable examples of the perfluorocarbon groups include perfluoromethyl, perfluoroethyl, perfluoropropyl, perfluorobutyl, perfluoroamyl, perfluorohexyl, perfluoroheptyl, and perfluoroctyl.

The amount of finely divided silica used in the present invention is, preferably, 1 to 200 parts by weight per 100 parts by weight of the resin. When the amount is less than 1 part by weight, the effects of the heat cured product of the coating material are insufficient. When the amount exceeds 200 parts by weight, the cured product becomes brittle. More preferably, 10 to 100 parts by weight of finely divided silica is added.

To form a homogeneous coating film, the finely divided silica should have an average diameter of primary particles of not more than 100 nm; preferably not more than 50 nm. To achieve uniform dispersion of finely divided silica in the solvent by suppressing the formation of secondary particles, the surface of the finely divided silica is preferably subjected to appropriate treatment, as long as this treatment is not detrimental to the purpose of the present invention. Examples of suitable finely divided silicas include colloidal silica and silica gels.

The coating material is used as a protective film that is formed on electrophotographic photosensitive bodies upon curing. For this reason, it is essential that dispersion should be carried out in solvents that are inert with respect to the substances constituting the charge transfer layer underneath the protective film. Pinene, as well as anthracene and other polycyclic aromatic compounds, carbazole, indole, oxazole, thiazole, oxathiazole, pyrazole, pyrazoline, thiadiazole, as well as triazole and other heterocyclic compounds, p-diethylaminobenzaldehydo-N,N-diphenylhydrazone, N,N-diphenylhydrazino- 3-methylidene-9-ethylcarbazole and other hydrazone compounds, α-phenyl-4'-N,N-diphenylaminostilbene, 5-(4-(di-p-tolylamino)benzylidene)-5H-dibenzo(a,d)cycloheptene and other stilbene compounds, benzidine compounds, triarylamine compounds or high molecular compounds having groups made up of these compounds in the main chain or side chains (poly-N-vinyl carbazole, polyvinyl anthracene, and the like) are examples of suitable charge transfer substances.

Where the charge transfer substances do not possess a film-forming capability, high molecular compounds can be mixed therewith as binders. Polyester, polycarbonate, polystyrene, polymethacrylic acid esters, polyacrylic acid esters, and the like are examples of suitable binders.

Preferably, the amount of the charge transfer compounds used in the charge transfer layer is not less than 20 wt % and not more than 70 wt % relative to the solid matter of the charge transfer layer. If the amount is less than 20 wt %, sufficient charge transfer capability is not obtained, and, therefore, an undesirable increase in residual potential and such occurs. When the amount exceeds 70 wt %, the mechanical strength of the charge transfer layer decreases, and, therefore, sufficient durability is not obtained.

When used in a single-layer photosensitive body, excellent characteristics are obtained by using a composition prepared by combining a high molecular compound, a charge transfer compound, and a charge generating material.

Additives can also be used in the photoconductive layer to increase durability and improve mechanical characteristics. Suitable additives include anti-oxidants, ultraviolet radiation absorbing agents, stabilizers, crosslinking agents, lubricants, conductivity-controlling agents, and the like. The surface-protecting layer is formed on top of the photoconductive layer formed as was described above. Additives that do not adversely affect the photoconductive layer are preferable as the additives employed in the composition used for the formation of the surface-protecting layer. The composition used for the formation of the protective layer is applied by dip coating, blade coating, roller coating, and like techniques.

Therefore, solvents used in resin coating solutions are inert to the charge transfer materials and high polymers serving as their binders. The solvents are alcohols. Lower alcohols are preferable because of their drying properties. Examples of suitable lower alcohols include methanol, ethanol, isopropanol, and butanol.

Preferably, solvents used for synthesis are selected from lower alcohols. Finely divided silica dispersed in a lower alcohol is mixed with a solvent containing a sufficient amount of water necessary for the hydrolysis of the silane. The silane is added thereto and subjected to hydrolytic condensation. Hydrolytic condensation can be accelerated by adding catalysts. Because the resin is used for electrophotographic photosensitive bodies, it is preferable to avoid using primary or secondary amines, which affect charge transfer. Suitable catalysts include organic acids such as formic acid, acetic acid, propionic acid, oxalic acid, malonic acid, glutaric acid, glycolic acid, tartaric acid, and esters thereof.

When the reaction is carried in this manner, the silanol groups remaining in the finely divided silica and the hydrolyzed silane compound react with each other, chemically fixing silica in polysiloxane. When it is applied as a coating and cured, the strength of the coating tends to improve. Hydroxyl groups and hydrolyzable groups are examples of the groups bonded to silicon in the molecule that remain in the polysiloxane. Residual hydroxyl groups and hydrolyzable groups are commonly used as crosslinkable functional groups. If there is an excessive amount of residual hydroxyl groups and hydrolyzable groups, the storage stability of the polysiloxane tends to drop. If the amount is too small, sufficient crosslinking does not take place. Preferably, the amount of these groups directly bonded to silicon atoms in the polysiloxane is 0.1 to 4 wt %.

The amount of hydroxyl and hydrolyzable groups can be set to the desired range by using methods known in the art. For example, alkoxysilanes and such may be added during or after synthesis of the polysiloxane. When crosslinking a polysiloxane with an adjusted amount of hydrolyzable groups, crosslinking can be carried out by adding crosslinking agents. Suitable crosslinking agents are silicon compounds having siloxane bonds and having multiple hydrolyzable groups or hydroxyl groups in each molecule.

Suitable hydrolyzable groups include methoxy, ethoxy, propoxy, acetoxy, butoxy, and methylethylketoxime.

Catalysts known in the art can be added in the process of curing to the coating materials, as long as they do not hamper charge transfer in the electrophotographic photosensitive bodies. Suitable catalysts include dimethylamine acetate, ethanolamine acetate, dimethylaniline formate, tetraethylammonium benzoate, sodium acetate, sodium propionate, sodium formate, benzyltrimethylammonium acetate, dibutyltin dilaurate, and the like.

The coating materials of this invention provide resins of superior surface hardness. When cured, the resins achieve optical characteristics required of electrophotographic photosensitive bodies. The resins have improved ability to withstand cleaning, so that surface tension is not reduced in the process of repeated cleaning and charging. The resins also have improved wear characteristics during toner cleaning and the like.

Leveling agents known in the art can also be added to the coating materials, as long as this is not detrimental to the purpose of this invention. Suitable leveling agents include polyester-modified silicones and the like.

The coating materials of this invention may be used on the charge transfer layer or on the charge generating layer of electrophotographic photosensitive bodies. FIG. 1(A) is a schematic cross sectional view of an electrophotographic photosensitive body. The coating material of this invention (1) is used for the layer that protects the surface of the charge transfer layer (2). The electrophotographic photosensitive body comprises the charge transfer layer (2), a charge generating layer (3), an undercoat layer (4), and an electrically conductive substrate (7). The electrically conductive substrate (7) comprises an electrically conductive layer (5) and a substrate (6).

FIG. 1(B) is a schematic cross sectional view of an electrophotographic photosensitive body. The coating material of this invention (1) is used for the layer that protects the surface of the charge generating layer (3). The electrophotographic photosensitive body comprises the charge generating layer (3), a charge transfer layer (2), an undercoat layer (4), and an electrically conductive substrate (7). The electrically conductive substrate (7) comprises an electrically conductive layer (5) and a substrate (6).

EXAMPLES

These examples are intended to illustrate the invention to those skilled in the art and should not be interpreted as limiting the scope of the invention set forth in the claims. "Water-base dispersion A of colloidal silica" is a water-base dispersion of colloidal silica with an average particle diameter of 10 to 20 nm and a solid weight of 40%.

"Isopropyl alcohol dispersion B of colloidal silica" is a dispersion of colloidal silica in isopropyl alcohol with an average particle diameter of 10 to 20 nm and a solid weight of 30%.

Water contact angles were measured using water contact angle measuring equipment, Model CA-D from Kyowa Kaimen Kagaku (K.K.).

Pencil hardness was measured in accordance with 8.4.2 of JIS K 5400 (pencil scratch value, manual technique). This technique is summarized as follows: A sample is fixed on a horizontal stand with its coated surface upward. A pencil is held at an angle of about 45° while pressing the pencil as hard as possible without breaking the core. The pencil is pressed forward at a speed of about 1 cm/s. The pencil hardness is recorded as one step below that pencil hardness that breaks the coating on the surface.

Example 1

8.7 g of water-base dispersion A of colloidal silica was placed in a flask, and 20.5 g of isopropyl alcohol dispersion B of colloidal silica, 25.6 g of methyltriethoxysilane, 5.9 g of 3,3,4,4,5,5,6,6,6-nonafluorohexyltrimethoxysilane, and 3.2 g of acetic acid were added thereto under agitation. The mixed solution was heated to 65~70° C., and reaction was conducted for 2 hours. The product was diluted with 21.7 g of isopropyl alcohol, and 2.4 g of dibutyltin dilaurate was added and homogeneously mixed therewith to prepare a photosensitive body surface coating material. Glass and polycarbonate substrates were spin coated with this material and dried at a temperature of 110° C. to produce a thin film. Water contact angle was 98.6°. Pencil hardness was 9H.

Example 2

32.07 g of isopropyl alcohol dispersion B of colloidal silica was placed in a flask, and 5.99 ml of water, 32.13 g of methyltriethoxysilane, 2.83 g of n-perfluoroctylethyltriethoxysilane, and 6.29 g of acetic acid were added thereto under agitation. The mixed solution was heated to 65~70° C. and reaction was conducted for 2 hours. The product was diluted with 7.8 g of isopropyl alcohol, 2.4 g of dibutyltin dilaurate was gradually added and homogeneously mixed therewith to prepare a photosensitive body surface coating material. Water contact angle and pencil hardness of the resultant thin film were, respectively, 101.1° and 9H.

Comparative Example 1

A polysiloxane that did not contain fluorohydrocarbon groups was synthesized using the same method as in Examples 1 and 2. 30.0 g of water-base dispersion A of colloidal silica was placed in a flask, and ⅓ of a mixture of 21.5 g of methyltrimethoxysilane and 3.5 g of acetic acid was added thereto under agitation. The mixed solution was heated to 55° C. and, immediately upon observing a violent exothermic reaction, it was cooled on ice and the rest of the mixture was added thereto while maintaining a temperature of 50~60° C. The reaction mixture was cooled to 20° C., and when its temperature was stabilized, agitation was carried out for 30 minutes. The reaction solution was diluted with 17.8 g of isopropyl alcohol, and 2.4 g of dibutyltin dilaurate was gradually added thereto. Precipitate was removed from the resultant reaction mixture, obtaining a coating material. Water contact angle and pencil hardness of the resultant thin film were measured as in Example 1. Water contact angle and pencil hardness were, respectively, 90.3° and 9H.

Example 3

8.0 g of water-base dispersion A of colloidal silica was placed in a flask, and 30.2 g of isopropyl alcohol dispersion B of colloidal silica, 19.8 g of methyltriethoxysilane, 7.3 g of γ-glycidoxypropyltrimethoxysilane, 3.3 g of perfluoroctylethyltriethoxysilane, and 9.3 g of acetic acid were added thereto under agitation. The mixed solution was heated to 65~70° C., and reaction was conducted for 2 hours. The product was diluted with 23.1 g of isopropyl alcohol, and 7.2 g dibutyltin dilaurate was gradually added and homogeneously mixed therewith to prepare a photosensitive body surface coating material. The water contact angle and pencil hardness were measured as in Example 1. Water contact angle was 102.1° and pencil hardness was 8H.

Example 4

11.7 g of water-base dispersion A of colloidal silica was placed in a flask, and 75.4 g of isopropyl alcohol dispersion B of colloidal silica, 17.4 g of methyltriethoxysilane, 23.1 g of γ-glycidoxypropyltrimethoxysilane, 7.2 g of 3,3,4,4,5,5,6,6,6-nonafluorohexyltrimethoxysilane, and 9.3 g of acetic acid were added thereto under agitation. The mixed solution was heated to 65~70° C., and reaction was conducted for 2 hours. The product was diluted with 69.9 g of isopropyl alcohol, and 7.2 g of dibutyltin dilaurate was gradually added and homogeneously mixed therewith to prepare a coating material. The water contact angle and pencil hardness were measured as in example 1. Water contact angle was 95.3° and pencil hardness was 8H.

Comparative Example 2

Polysiloxane that did not contain fluorohydrocarbon groups was synthesized by the same method as in examples 3 and 4. 14.2 g of water-base dispersion A of colloidal silica was placed in a flask, and 79.8 g isopropyl alcohol dispersion B of colloidal silica, 22.7 g of methyltriethoxysilane, 30.2 g of γ-glycidoxypropyltrimethoxysilane, and 9.6 g of acetic acid were added thereto under agitation. The mixed solution was heated to 65~70° C., and reaction was conducted for 2 hours. The product was diluted in 26.2 g of isopropyl alcohol, and 7.4 g of dibutyltin dilaurate was gradually added thereto. Water contact angle and pencil hardness of the resultant thin film were measured as in example 1. Water contact angle was 84.9° and pencil hardness was 9H.

Reference Example 1

A glass substrate was bar coated with the coating material of Example 1 and subjected to heat treatment at a temperature of 110° C. for 4 hours to dry it. A 1 μm thick uniform transparent film was obtained. The resultant sample was examined under an electron microscope, and found to have a uniform film.

Furthermore, absorption at a wavelength of 600 nm was measured using a spectrophotometer. The uniform film was transparent, with an absorbance of 0.001 per 1 μm of film thickness. The uniform film had a water contact angle of 99° and a significant pencil hardness of 9H.

Reference Example 2

4-{2-(triethoxysilyl)ethyl}triphenylamine and a polycarbonate resin (Z-200™, from Mitsubishi Gas Chemical Company, Inc.) were dissolved in tetrahydrofuran so that their content was, respectively, 50 wt % and 50 wt % converted to solid matter.

An aluminum plate with a thickness of 50 μm was bar coated therewith, and dried for 1 hour at a temperature of 120° C. A uniform transparent film with a thickness of 20 μm was obtained. The coating material prepared in Example 1 was applied by means of bar coating and was dried by heating at a temperature of 110° C. for 4 hours. A film with a thickness of 1 μm was obtained as a surface-protecting layer. The film was examined under an electron microscope, was found to be uniform.

A degradation test was conducted for 1 hour by bringing an electrically conductive rubber roller in contact with this sample, using the aluminum plate as earth, applying a voltage of 600 V to the electrically conductive rubber roller, and passing an alternating current of 1500 Hz, with 1500 V between peaks. In the course of the degradation test, a depression due to discharge was produced in the vicinity of the section, where the electrically conductive rubber roller was in contact with the sheet, and the depth of this depression was measured as a criterion of discharge resistance. The depression in the sheet was extremely small, less than 0.1 μm.

The water contact angle of the discharge section was excellent at 95°, compared with 99° prior to the degradation test.

Reference Example 3

4-{2-(triethoxysilyl)ethyl}triphenylamine and polycarbonate resin (Z-200™, from Mitsubishi Gas Chemical Company, Inc.) were dissolved in tetrahydrofuran so that their content was, respectively, 50 wt %, 50 wt % as converted to solid matter.

A 50 μm thick aluminum plate was bar coated with this solution and dried for 1 hour at 120° C. A uniform transparent film with a thickness of 20 μm was obtained. The coating material prepared in Example 1 was applied by bar coating. The sample was dried by heating for 4 hours at 110° C. A film with a thickness of 1 μm was obtained as a surface-protecting layer. Examination under an electron microscope showed that the film was uniform.

Reference Example 4

An electrically conductive substrate was obtained by forming alumite, by anodic oxidation on an aluminum cylinder with an external diameter of 60 mm that had been subjected to mirror finish treatment. Charge generating material was obtained by adding 5 parts by weight of bis-azo pigment indicated below to a solution obtained by dissolving 2 parts of polyvinylbenzal (degree of benzalification: 75 wt % or higher) in 95 parts of cyclohexanone and subjecting the mixture to dispersion for 20 minutes in a sand mill. The charge generating material was used for the charge generating layer. It was applied by dip coating in a manner that provided a film of thickness 0.2 μm after drying the dispersion on the electrically conductive substrate.

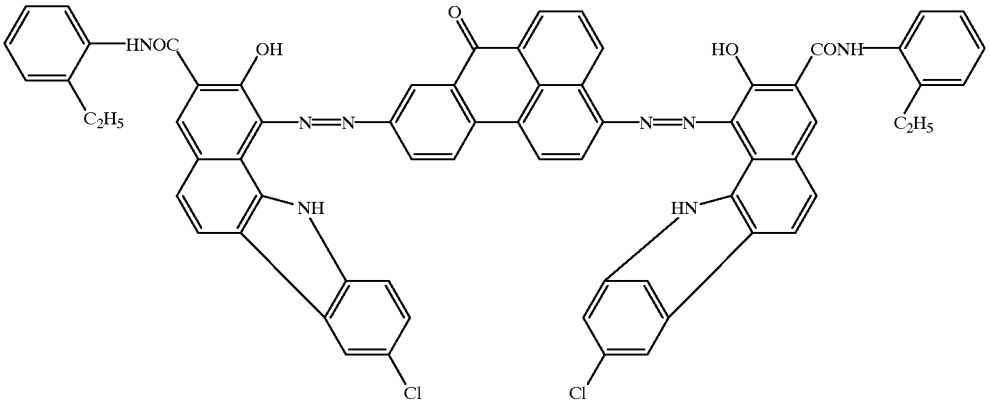

Bis-azo Pigment

A solution for the charge transfer layer was obtained by dissolving 5 parts of triarylamine compound, having the formula indicated below, and 5 parts of polycarbonate resin (Z-400, from Mitsubishi Gas Chemical Company, Inc.) in 70 parts of tetrahydrofuran was applied to the charge generating layer by dip coating, producing a film thickness of 12 $\mu$m after drying.

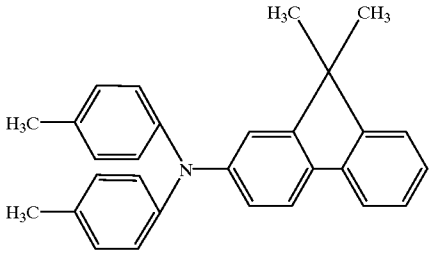

The coating material of Example 1 was applied to the charge transfer layer by dip coating, and a film thickness of 1 $\mu$m was obtained after heat treatment for 4 hours at 110° C.

By measuring electrophotographic characteristics at a wavelength of 680 nm upon charging to −700 V, it was determined that E1/2 (exposure required for the electrostatic potential to be reduced to −350 V)=1.2 $\mu$J/cm$^2$, and the residual potential was excellent, 28 V.

Image evaluation was conducted using an initial charging potential of −600 V with an evaluation apparatus made by remodeling a digital copying machine, the GP55 from Canon (roller charging type), to obtain the scanning spot diameter. The amount of wear of the photosensitive body after a durability test involving copying 4000 pages was extremely small, less than 0.1 $\mu$m. The water contact angle was excellent at 98°. There was no image degradation, with sufficient pixel reproduction in the highlight section when inputting a signal equivalent to 600 dpi.

We claim:

1. A process for the preparation of a photosensitive body surface coating material, the process comprising:

i) forming a polysiloxane and coating the polysiloxane on a substrate, wherein the polysiloxane is formed by hydrolytic condensation of a silane in the presence of a mixed solvent comprising alcohol and water in the presence of finely divided silica; wherein the silane has a formula $R^2Si(OR^3)_3$, wherein each $R^2$ is selected from the group consisting of fluorohydrocarbon groups of 3 to 12 carbon atoms, saturated hydrocarbon groups of 1 to 18 carbon atoms, saturated hydrocarbon groups of 1 to 18 carbon atoms having oxygen atoms, and aromatic hydrocarbon groups of 6 to 18 carbon atoms; and $R^3$ is a straight-chain saturated hydrocarbon group of 1 to 8 carbon atoms; and ii) heat curing the polysiloxane to form a polysiloxane resin of formula $R^1SiO_{3/2}$, wherein each $R^1$ is selected from the group consisting of fluorohydrocarbon groups of 3 to 12 carbon atoms, saturated hydrocarbon groups of 1 to 18 carbon atoms, saturated hydrocarbon groups of 1 to 18 carbon atoms having oxygen atoms, and aromatic hydrocarbon groups of 6 to 18 carbon atoms; and with the proviso that not less than 1 mol % and not more than 80 mol % of all the $R^1$ groups are fluorohydrocarbon groups; and wherein the polysiloxane is selected such that, after heat curing, the polysiloxane resin has a water contact angle of not less than 95°.

2. The process of claim 1, wherein the fluorohydrocarbon groups for $R^2$ are perfluorocarbon groups bonded to silicon atoms through ethylene groups, wherein the perfluorocarbon groups are selected from the group consisting of perfluoromethyl, perfluoroethyl, perfluoropropyl, perfluorobutyl, perfluoroamyl, perfluorohexyl, perfluoroheptyl, and perfluoroctyl.

3. The process of claim 1, wherein the amount of finely divided silica is 1 to 200 parts by weight, per 100 parts by weight of the polysiloxane resin.

4. The process of claim 3, wherein the amount of finely divided silica is 10 to 100 parts by weight.

5. The process of claim 1, wherein the finely divided silica has an average primary particle diameter of not more than 100 nm.

6. The process of claim 5, wherein the average primary particle diameter is not more than 50 nm.

7. The process of claim 1, wherein hydrolytically condensing the silane is accelerated by adding a catalyst.

8. The process of claim 7, wherein the catalyst is selected from the group consisting of organic acids and organic acid esters.

9. The process of claim 1, wherein the polysiloxane contains 0.1 to 4 weight % excess hydroxyl and hydrolyzable groups.

10. The process of claim 1, wherein a catalyst is added when curing the polysiloxane.

11. The process of claim 10, wherein the catalyst is selected from the group consisting of dimethylamine acetate, ethanolamine acetate, dimethyl aniline formate, tetraethylammonium benzoate, sodium acetate, sodium propionate, sodium formate, benzyltrimethylammonium acetate, dibutyltin dilaurate.

12. The process of claim 1, wherein the photosensitive body surface coating material is a photosensitive drum coating material.

13. The process of claim 1, wherein the photosensitive body surface coating material further comprises a leveling agent.

14. The process of claim 13, wherein the leveling agent is a polyester-modified silicone.

15. The process of claim 1, wherein the silane comprises one or more alkoxysilanes selected from the group consisting of 3,3,4,4,5,5,6,6,6-nonafluorohexyltrimethoxysilane and perfluoroctylethyltriethoxysilane.

16. The process of claim 1, wherein the finely divided silica is colloidal silica dispersed in a lower alcohol.

* * * * *